US009620052B2

(12) United States Patent
Choi et al.

(10) Patent No.: US 9,620,052 B2
(45) Date of Patent: Apr. 11, 2017

(54) METHOD OF CONTROLLING A DIMMING OPERATION, DIMMING OPERATION CONTROL DEVICE, AND FLAT PANEL DISPLAY DEVICE HAVING THE SAME

(71) Applicant: Samsung Display Co., Ltd., Yongin (KR)

(72) Inventors: Yong-Seok Choi, Yongin (KR); Byung-Ki Chun, Yongin (KR); Jong-Woong Park, Yongin (KR); Joo-Hyung Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 270 days.

(21) Appl. No.: 13/930,451

(22) Filed: Jun. 28, 2013

(65) Prior Publication Data

US 2014/0063078 A1 Mar. 6, 2014

(30) Foreign Application Priority Data

Aug. 30, 2012 (KR) ..... 10-2012-0095331

(51) Int. Cl.
*G09G 3/22* (2006.01)
*G09G 3/20* (2006.01)
(Continued)

(52) U.S. Cl.
CPC ..... *G09G 3/22* (2013.01); *G09G 3/20* (2013.01); *G09G 3/3208* (2013.01);
(Continued)

(58) Field of Classification Search
None
See application file for complete search history.

(56) References Cited

U.S. PATENT DOCUMENTS

2004/0213457 A1* 10/2004 Mori ..... G06T 5/009 382/167
2006/0012615 A1* 1/2006 Mori ..... G09G 3/22 345/690
(Continued)

FOREIGN PATENT DOCUMENTS

EP 1310935 A2 * 5/2003 ..... G09G 3/20
JP EP 1310935 A2 * 5/2003 ..... G09G 3/22
(Continued)

*Primary Examiner* — Douglas Wilson
(74) *Attorney, Agent, or Firm* — Knobbe, Martens, Olson & Bear LLP

(57) ABSTRACT

A method of controlling a dimming operation is disclosed. In one aspect, the method includes determining the brightness of an input image frame based on input image data, determining an input dimming value based on the brightness of the input image frame, selectively performing the dimming operation is based on a comparison of an absolute value of a difference between the input dimming value and a current output dimming value against a predetermined threshold value, where a value generated by adjusting the current output dimming value by a predetermined adjustment value is output as a next output dimming value when performing the dimming operation, and the input dimming value is output as the next output dimming value when not performing the dimming operation.

16 Claims, 14 Drawing Sheets

(51) Int. Cl.
*G09G 3/3208* (2016.01)
*G09G 3/36* (2006.01)

(52) U.S. Cl.
CPC ... *G09G 3/3611* (2013.01); *G09G 2320/0633* (2013.01); *G09G 2320/0646* (2013.01); *G09G 2340/16* (2013.01); *G09G 2360/16* (2013.01)

(56) References Cited

U.S. PATENT DOCUMENTS

2011/0141166 A1* 6/2011 Ahn ..... G09G 3/3426
345/691
2012/0056907 A1* 3/2012 Lee ..... G09G 3/3426
345/690
2012/0268505 A1* 10/2012 Tani ..... G09G 3/342
345/694
2013/0083083 A1* 4/2013 Woo ..... G09G 3/3208
345/690

FOREIGN PATENT DOCUMENTS

KR 10-2011-0066510 A 6/2011
KR 10-2011-0070234 A 6/2011
KR 10-2012-0005916 A 1/2012
KR 20130083083 A * 7/2013

* cited by examiner

METHOD OF CONTROLLING A DIMMING OPERATION, DIMMING OPERATION CONTROL DEVICE, AND FLAT PANEL DISPLAY DEVICE HAVING THE SAME

CROSS-REFERENCE TO RELATED APPLICATIONS

This application claims priority under 35 USC §119 to Korean Patent Applications No. 10-2012-0095331, filed on Aug. 30, 2012 in the Korean Intellectual Property Office (KIPO), the contents of which are incorporated herein in its entirety by reference.

BACKGROUND

Field

Example embodiments relate generally to a dimming technique for flat panel display devices. More particularly, embodiments of the inventive concept relate to a method of controlling a dimming operation, a dimming operation control device, and a flat panel display device having the dimming operation control device.

Description of the Related Technology

Generally, electronic devices include output devices such as sound devices, display devices, etc. Recently, flat panel display devices (e.g., a liquid crystal display device, an organic light emitting display device, etc.) have been in wide use for various electronic devices. In the case of the liquid crystal display devices, luminance of a pixel can be determined by multiplying luminance of a backlight unit by light-transmittance of a liquid crystal layer, where the light-transmittance is adjusted based on data applied to each pixel. In the case of the organic light emitting display devices, luminance of pixel can be determined by adjusting a voltage and/or a current applied to each pixel.

Flat panel display devices can employ a dimming technique to improve contrast ratio and/or to reduce power consumption. Specifically, a dimming operation can be performed on a liquid crystal display device by determining a dimming value based on the brightness of an input image frame, adjusting the luminance of the backlight unit based on the determined dimming value, and compensating an input image data based on the adjusted luminance of the backlight unit. In addition, a dimming operation can be performed on an organic light emitting display device by determining the dimming value based on the brightness of the input image frame and adjusting the voltage and/or the current applied to each pixel based on the determined dimming value.

However, conventional dimming techniques sequentially (e.g., linearly or non-linearly) increases or decreases the dimming value based on the brightness of the input image frame. In these techniques, the dimming value is increased or decreased even when the brightness of the input image frame is rapidly changed (e.g., when the input image frame is changed from a black color image frame to a white color image frame, or from the white color image frame to the black color image frame). As a result, the conventional dimming techniques cannot prevent a phenomenon in which an image output from the flat panel display device sequentially becomes brighter or darker. Since the phenomenon results in brightness changes or color changes of the image output from the flat panel display device, an image quality of the flat panel display device may be degraded.

SUMMARY OF CERTAIN INVENTIVE ASPECTS

Example embodiments provide a method of controlling a dimming operation capable of preventing brightness changes or color changes of an image output from a flat panel display device even when an input image frame changes rapidly (e.g., even when the input image frame is changed from a black color image frame to a white color image frame, or from the white color image frame to the black color image frame).

Example embodiments provide a dimming operation control device capable of preventing brightness changes or color changes of an image output from a flat panel display device even when an input image frame is rapidly changed.

Example embodiments provide a flat panel display device having the dimming operation control device capable of displaying a high-quality image.

According to some example embodiments, a method of controlling a dimming operation includes judging or determining a brightness of an input image frame based on an input image data, determining an input dimming value based on the brightness of the input image frame, deciding whether or not to perform the dimming operation by comparing an absolute value of a difference between the input dimming value and a current output dimming value against a predetermined threshold value, outputting as a next output dimming value one of a value generated by adjusting the current output dimming value by a predetermined adjustment value when deciding to perform the dimming operation and the input dimming value when deciding not to perform the dimming operation.

In example embodiments, the step of determining the brightness of the input image frame may include a step of converting the input image data corresponding to RGB data into a luminance signal including brightness information, and a step of setting the brightness of the input image frame as an average brightness after calculating the average brightness based on the luminance signal.

In example embodiments, determining the input dimming value may include a step of selecting a dimming value matched to the brightness of the input image frame using a look-up table as the input dimming value.

In example embodiments, deciding whether or not to perform the dimming operation may include one of deciding to perform the dimming operation when the absolute value of the difference between the input dimming value and the current output dimming value is smaller than the predetermined threshold value and deciding not to perform the dimming operation when the absolute value of the difference between the input dimming value and the current output dimming value is greater than the predetermined threshold value.

In example embodiments, outputting the value generated by adjusting the current output dimming value by the predetermined adjustment value as the next output dimming value may include outputting as the next output dimming value one of a value generated by decreasing the current output dimming value by the predetermined adjustment value as the next output dimming value when the input dimming value is smaller than the current output dimming value and a value generated by increasing the current output dimming value by the predetermined adjustment value when the input dimming value is greater than the current output dimming value.

In example embodiments, the dimming operation may correspond to a local dimming operation. Here, the dimming operation may be separately performed on respective regions of a display panel of a flat panel display device.

In example embodiments, the dimming operation may correspond to a global dimming operation. Here, the dimming operation may be simultaneously performed on an entire region of a display panel of a flat panel display device.

According to some example embodiments, a dimming operation control device may include a brightness detection block configured to receive an input image data from outside, and to determine a brightness of an input image frame based on the input image data, an input dimming value determination block configured to determine an input dimming value based on the brightness of the input image frame, and a dimming operation control block configured to decide whether or not to perform a dimming operation by comparing an absolute value of a difference between the input dimming value and a current output dimming value against a predetermined threshold value, to output as a next output dimming value one of a value generated by adjusting the current output dimming value by a predetermined adjustment value when deciding to perform the dimming operation the input dimming value when deciding not to perform the dimming operation.

In example embodiments, the brightness detection block may convert the input image data corresponding to RGB data into a luminance signal including brightness information, and may set the brightness of the input image frame as an average brightness after calculating the average brightness based on the luminance signal.

In example embodiments, the input dimming value determination block may select a dimming value matched to the brightness of the input image frame using a look-up table as the input dimming value.

In example embodiments, the dimming operation control block may decide to perform the dimming operation when the absolute value of the difference between the input dimming value and the current output dimming value is smaller than the predetermined threshold value, and may decide not to perform the dimming operation when the absolute value of the difference between the input dimming value and the current output dimming value is greater than the predetermined threshold value.

In example embodiments, the dimming operation control block may output as the next output dimming value one of a value generated by decreasing the current output dimming value by the predetermined adjustment value when the input dimming value is smaller than the current output dimming value and a value generated by increasing the current output dimming value by the predetermined adjustment value when the input dimming value is greater than the current output dimming value.

In example embodiments, the dimming operation may correspond to a local dimming operation. Here, the dimming operation may be separately performed on respective regions of a display panel of a flat panel display device.

In example embodiments, the dimming operation may correspond to a global dimming operation. Here, the dimming operation may be simultaneously performed on an entire region of a display panel of a flat panel display device.

According to some example embodiments, a flat panel display device may include a display panel including a plurality of pixels having respective organic light emitting diodes, a scan driving unit configured to provide a scan signal to the pixels, a data driving unit configured to provide a data signal to the pixels, a power unit configured to provide a high power voltage and a low power voltage to the pixels, a timing control unit configured to control the scan driving unit, the data driving unit, and the power unit, and a dimming operation control unit configured to selectively perform a dimming operation by comparing an absolute value of a difference between an input dimming value and a current output dimming value against a predetermined threshold value when performing the dimming operation by controlling the power unit based on a brightness of an input image frame.

In example embodiments, the dimming operation control unit may be coupled to the timing control unit, or located in the timing control unit.

In example embodiments, the dimming operation control unit may include a brightness detection block configured to receive an input image data from outside, and to determine the brightness of the input image frame based on the input image data, an input dimming value determination block configured to determine the input dimming value based on the brightness of the input image frame, and a dimming operation control block configured to decide whether to perform the dimming operation by comparing the absolute value of the difference between the input dimming value and the current output dimming value against the predetermined threshold value, to output as a next output dimming value one of a value generated by adjusting the current output dimming value by a predetermined adjustment value when deciding to perform the dimming operation and to output the input dimming value when deciding not to perform the dimming operation.

According to some example embodiments, a flat panel display device may include a display panel including a plurality of pixels having respective liquid crystal layers, a scan driving unit configured to provide a scan signal to the pixels, a data driving unit configured to provide a data signal to the pixels, a backlight unit configured to provide light to the display panel, a timing control unit configured to control the scan driving unit, the data driving unit, and the backlight unit, and a dimming operation control unit configured to selectively perform a dimming operation by comparing an absolute value of a difference between an input dimming value and a current output dimming value against a predetermined threshold value when performing the dimming operation by controlling the backlight unit based on a brightness of an input image frame.

In example embodiments, the dimming operation control unit may be coupled to the timing control unit, or located in the timing control unit.

In example embodiments, the dimming operation control unit may include a brightness detection block configured to receive an input image data from outside, and to determine the brightness of the input image frame based on the input image data, an input dimming value determination block configured to determine the input dimming value based on the brightness of the input image frame, and a dimming operation control block configured to decide whether to perform the dimming operation by comparing the absolute value of the difference between the input dimming value and the current output dimming value with the predetermined threshold value, to output as a next output dimming value one of a value generated by adjusting the current output dimming value by a predetermined adjustment value when deciding to perform the dimming operation and to output the input dimming value when deciding not to perform the dimming operation.

Therefore, a method of controlling a dimming operation according to example embodiments may selectively perform a dimming operation by comparing an absolute value of a difference between an input dimming value and a current output dimming value with a predetermined threshold value when performing the dimming operation based on a brightness of an input image frame. As a result, the method of controlling the dimming operation may prevent brightness changes or color changes of an image output from a flat panel display device even when the brightness of the input image frame changes rapidly (e.g., even when the input image frame is changed from a black color image frame to a white color image frame, or from the white color image frame to the black color image frame).

In addition, a dimming operation control device according to example embodiments may selectively perform a dimming operation by comparing an absolute value of a difference between an input dimming value and a current output dimming value with a predetermined threshold value when performing the dimming operation based on a brightness of an input image frame. As a result, the dimming operation control device may prevent brightness changes or color changes of an image output from a flat panel display device even when the brightness of the input image frame is rapidly changed.

Furthermore, a flat panel display device having the dimming operation control device according to example embodiments may output (i.e., display) a high-quality image.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

Figure 1:
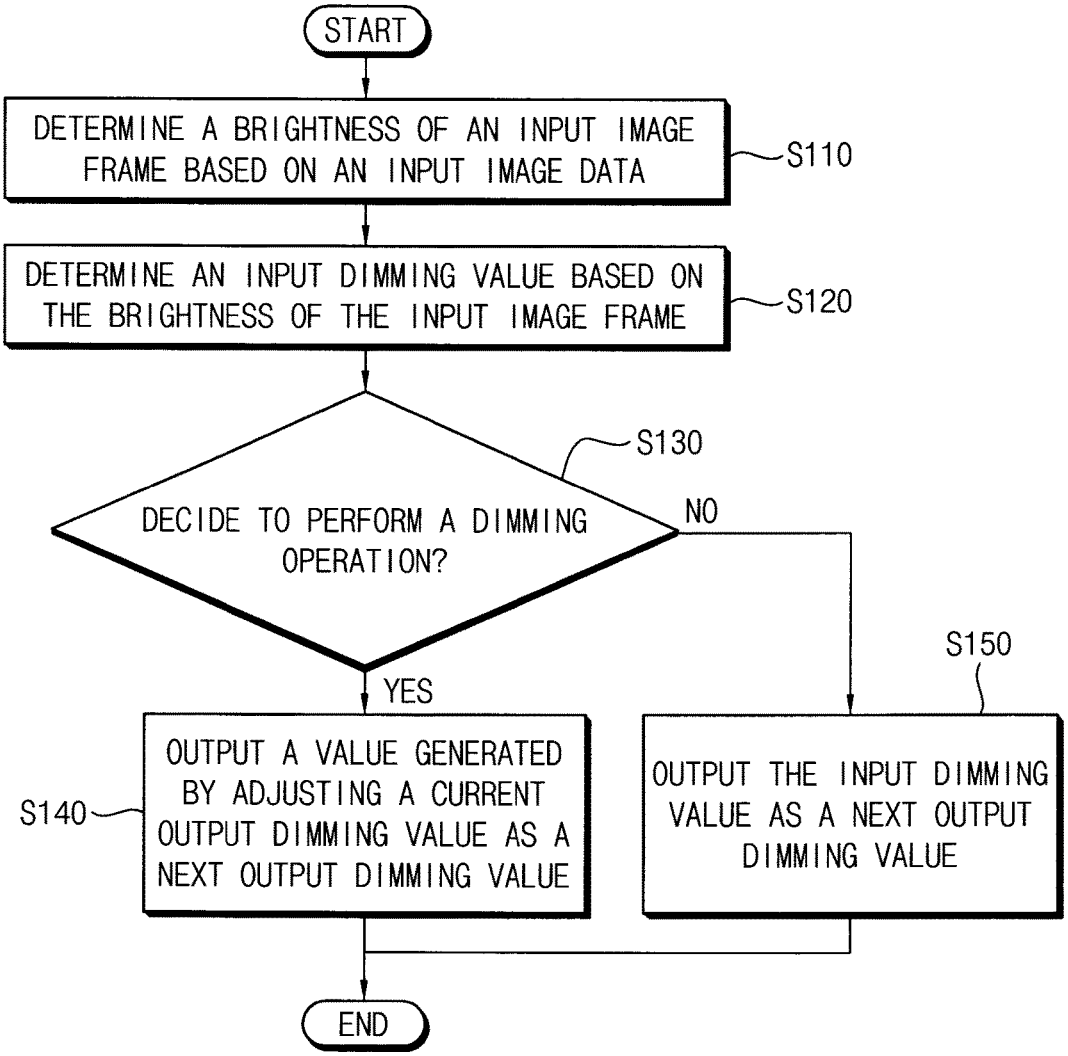
FIG. 1 is a flow chart illustrating a method of controlling a dimming operation according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a flow chart illustrating a method of controlling a dimming operation according to example embodiments.

Referring to FIG. 1, the method of controlling a dimming operation according to one embodiment includes determining a brightness of an input image frame based on an input image data (Step S110), determining an input dimming value based on the brightness of the input image frame (Step S120), and deciding whether to perform a dimming operation by comparing an absolute value of a difference between the input dimming value and a current output dimming value against a predetermined threshold value (Step S130). Here, when it is decided to perform the dimming operation, the method of FIG. 1 further includes outputting a value generated by adjusting (i.e., increasing or decreasing) the current output dimming value by a predetermined adjustment value as a next output dimming value (Step S140). On the other hand, when it is decided not to perform the dimming operation, the method of FIG. 1 further includes outputting the input dimming value as the next output dimming value (Step S150).

Generally, in a flat panel display device (e.g., a liquid crystal display device, an organic light emitting display device, etc.) employing a dimming technique, the dimming value is sequentially (e.g., linearly or non-linearly) increased or decreased based on the brightness of the input image frame. Therefore, even when the brightness of the input image frame is rapidly changed, an image output from the flat panel display device sequentially becomes brighter or darker. In other words, conventional dimming techniques sequentially increase or decrease the dimming value even when it is expected that the brightness of the input image frame will rapidly change. Thus, the brightness or the color of an image output from the flat panel display device can change. As a result, the image quality of the flat panel display device may be degraded because a user can notice the brightness changes or the color changes of the image output from the flat panel display device. To overcome these problems, the method of FIG. 1 can selectively performs the dimming operation by comparing the absolute value of the difference between the input dimming value and the current output dimming value against the predetermined threshold value when performing the dimming operation based on the brightness of the input image frame. Thus, the method of FIG. 1 can prevent the brightness changes or the color changes of the image output from the flat panel display device. Hereinafter, the method of FIG. 1 will be described in detail.

The method of controlling the dimming operation illustrated in FIG. 1 includes determining the brightness of the input image frame based on the input image data (Step S110). In one example embodiment, the method of FIG. 1 may determine the brightness of the input image frame by converting the input image data corresponding to RGB data into a luminance signal (i.e., Y signal) including brightness information, by calculating an average brightness based on the luminance signal, and setting the brightness of the input image frame as the average brightness. Subsequently, the method of FIG. 1 determines the input dimming value based on the brightness of the input image frame (Step S120). In one example embodiment, the method illustrated in FIG. 1 may determines the input dimming value by selecting a dimming value matched to the brightness of the input image frame using a look-up table. Here, the look-up table may store a plurality of dimming values matched to a plurality of brightness of the input image frame, respectively. It should be understood to a person skilled in the art that the look-up table can be implemented using any storage device capable of storing a plurality of dimming values matched to a plurality of brightness of the input image frame, respectively.

After the input dimming value is determined based on the brightness of the input image frame, the method of controlling the dimming operation illustrated in FIG. 1 includes deciding whether or not to perform the dimming operation by comparing the absolute value of the difference between the input dimming value and the current output dimming value against the predetermined threshold value (Step S130). Here, it will be recognized that the input dimming value corresponds to the input image frame that is currently being inputted, and that the current output dimming value corresponds to the input image frame that is currently being outputted. In other words, after a display operation for the input image frame that is currently being outputted is completed, the flat panel display device begins to perform a display operation for the input image frame that is currently being inputted. In one aspect of the embodiment illustrated in FIG. 1, the method of controlling the dimming operation includes deciding to perform the dimming operation if the absolute value of the difference between the input dimming value and the current output dimming value is smaller than the predetermined threshold value. In another aspect of the embodiment illustrated in FIG. 1, the method of controlling the dimming operation includes deciding not to perform the dimming operation if the absolute value of the difference between the input dimming value and the current output dimming value is greater than the predetermined threshold value. That is, one aspect of the method illustrated in FIG. 1 includes gradually adjusting the brightness of the image output from the flat panel display device by performing the dimming operation when the absolute value of the difference between the input dimming value and the current output dimming value is relatively small (i.e., when it is expected that the brightness of the image output from the flat panel display device will gradually change). In contrast, another aspect of the method illustrated in FIG. 1 includes promptly counteracting rapid brightness changes of the image output from the flat panel display device (i.e., may not perform the dimming operation) when the absolute value of the difference between the input dimming value and the current output dimming value is relatively large (i.e., when it is expected that the brightness of the image output from the flat panel display device will rapidly change).

In detail, one aspect of the method of controlling the dimming operation illustrated in FIG. 1 includes outputting the value generated by adjusting (i.e., increasing or decreasing) the current output dimming value by the predetermined adjustment value as the next output dimming value (Step S140) when the absolute value of the difference between the input dimming value and the current output dimming value is smaller than the predetermined threshold value (i.e., when it is decided to perform the dimming operation). Here, the method of FIG. 1 may output a value generated by decreasing the current output dimming value by the predetermined adjustment value as the next output dimming value when the input dimming value is smaller than the current output dimming value, and may output a value generated by increasing the current output dimming value by the predetermined adjustment value as the next output dimming value when the input dimming value is greater than the current output dimming value. As described above, in one aspect of the method, when the absolute value of the difference between the input dimming value and the current output dimming value is smaller than the predetermined threshold value, the method of FIG. 1 gradually adjusts the brightness of the image output from the flat panel display device by adjusting the current output dimming value based on a comparison between the input dimming value and the current output dimming value. On the other hand, in another aspect of the method, when the absolute value of the difference between the input dimming value and the current output dimming value is greater than the predetermined threshold value, the method of FIG. 1 may output the input dimming value as the next output dimming value (Step S150). That is, when the absolute value of the difference between the input dimming value and the current output dimming value is greater than the predetermined threshold value, the method of FIG. 1 may promptly counteract the rapid brightness changes of the image output from the flat panel display device by directly applying the input dimming value.

In conclusion, the method of controlling the dimming operation illustrated in FIG. 1 includes selectively performing the dimming operation by comparing the absolute value of the difference between the input dimming value and the current output dimming value with the predetermined threshold value when performing the dimming operation based on the brightness of the input image frame. Thus, the method of FIG. 1 can prevent the bright changes or the color changes of the image output from the flat panel display device when the brightness of the input image frame is rapidly changed (e.g., when the input image frame is changed from a black color image frame to a white color image frame, or from the white color image frame to the black color image frame). Therefore, the method of FIG. 1 may allow the flat panel display device to display higher quality images compared to images generated using conventional dimming techniques, most of which adjust the brightness of the input image frame sequentially (e.g., linearly or non-linearly) even when the brightness of the input image frame is rapidly changed. Meanwhile, the predetermined threshold value and the predetermined adjustment value can be determined in various ways according to required conditions for the flat panel display device. In one example embodiment, the dimming operation corresponds to a local dimming operation. In this embodiment, the method of FIG. 1 includes separately performing the dimming operation on respective regions of the display panel of the flat panel display device. In another example embodiment, the dimming operation corresponds to a global dimming operation. In this embodiment, the method of FIG. 1 includes simultaneously performing the dimming operation on an entire region of the display panel of the flat panel display device.

Figure 2:
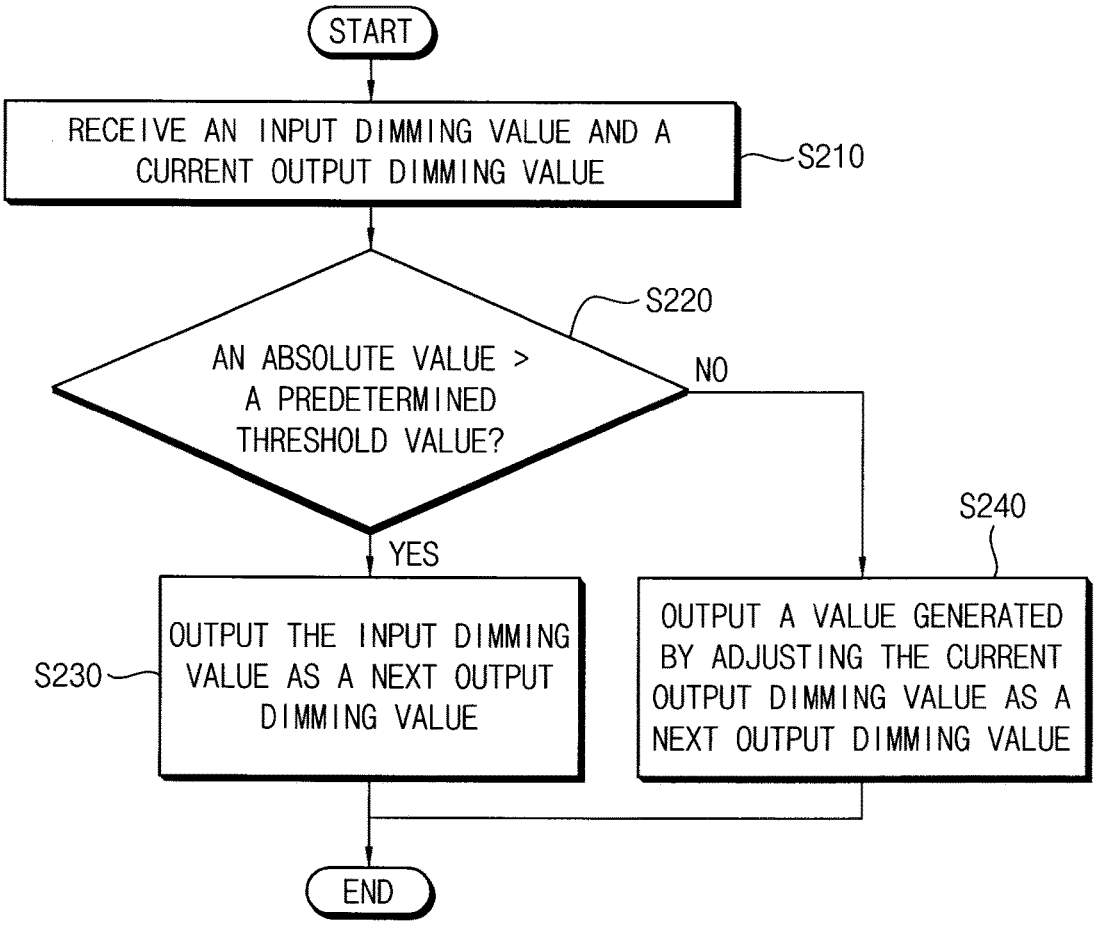
FIG. 2 is a flow chart illustrating an example in which a method of FIG. 1 decides whether to perform a dimming operation.
Figure 3:
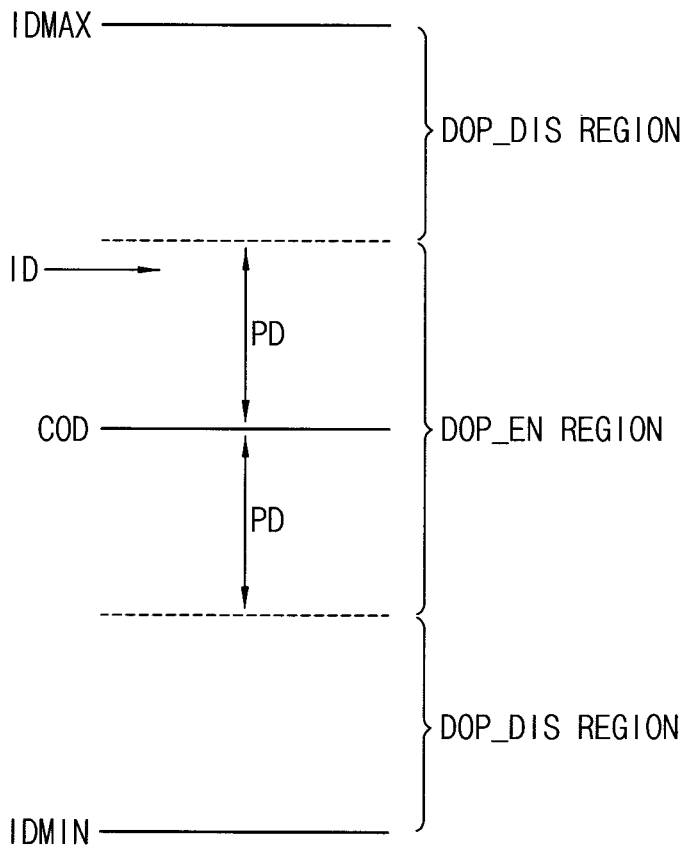
FIG. 3 is a diagram illustrating an example in which a method of FIG. 1 decides whether to perform a dimming operation.

FIG. 2 is a flow chart illustrating an example in which the method of FIG. 1 includes deciding whether or not to perform a dimming operation. FIG. 3 is a diagram illustrating an example in which the method of FIG. 1 includes deciding whether or not to perform a dimming operation based on relative values of the input dimming value (ID) and the current output dimming value (COD).

Referring to FIGS. 2 and 3, the method of controlling a dimming operation according to one aspect of the embodiment of FIG. 1 includes receiving an input dimming value ID and a current output dimming value COD (Step S210), and determine whether an absolute value of a difference between the input dimming value ID and the current output dimming value COD is greater than a predetermined threshold value PD (Step S220). Here, when the absolute value of the difference between the input dimming value ID and the current output dimming value COD is greater than the predetermined threshold value PD, the method of FIG. 1 outputs the input dimming value ID as a next output dimming value (Step S230). That is, a dimming operation is not be performed in a dimming operation disable region DOP_DIS REGION (i.e., when the absolute value of the difference between the input dimming value ID and the current output dimming value COD is greater than the predetermined threshold value PD). On the other hand, when the absolute value of the difference between the input dimming value ID and the current output dimming value COD is smaller than the predetermined threshold value PD, the method of FIG. 1 outputs a value generated by adjusting (i.e., increasing or decreasing) the current output dimming value COD by a predetermined adjustment value as the next output dimming value (Step S240). That is, a dimming operation is performed in a dimming operation enable region DOP_EN REGION (i.e., when the absolute value of the difference between the input dimming value ID and the current output dimming value COD is smaller than the predetermined threshold value PD). In example embodiments, the input dimming value ID may be between a maximum input dimming value IDMAX and a minimum input dimming value IDMIN.

Specifically, the difference between the input dimming value ID and the current output dimming value COD may be large when an image output from a flat panel display device rapidly becomes brighter. Thus, the method of FIG. 1 may promptly counteract rapid brightness changes of the image output from the flat panel display device by outputting the input dimming value ID as the next output dimming value without sequentially (e.g., linearly or non-linearly) increasing the brightness of the input image frame. Similarly, the difference between the input dimming value ID and the current output dimming value COD may also be large when the image output from the flat panel display device rapidly becomes darker. Thus, controlling a dimming operation according to the illustrated embodiment of FIG. 1 can include promptly counteracting rapid changes in brightness of the image output from the flat panel display device by outputting the input dimming value ID as the next output dimming value without sequentially (e.g., linearly or non-linearly) decreasing the brightness of the input image frame. In conclusion, the brightness of the input image frame can be sequentially adjusted in the dimming operation enable region DOP_EN REGION, but can be non-sequentially adjusted in the dimming operation disable region DOP_DIS REGION. As a result, the method of FIG. 1 may provide (i.e., maintain) advantages of the conventional dimming techniques, and may prevent the brightness changes or the color changes of the image output from the flat panel display device when the brightness of the input image frame is rapidly changed.

Figure 4:
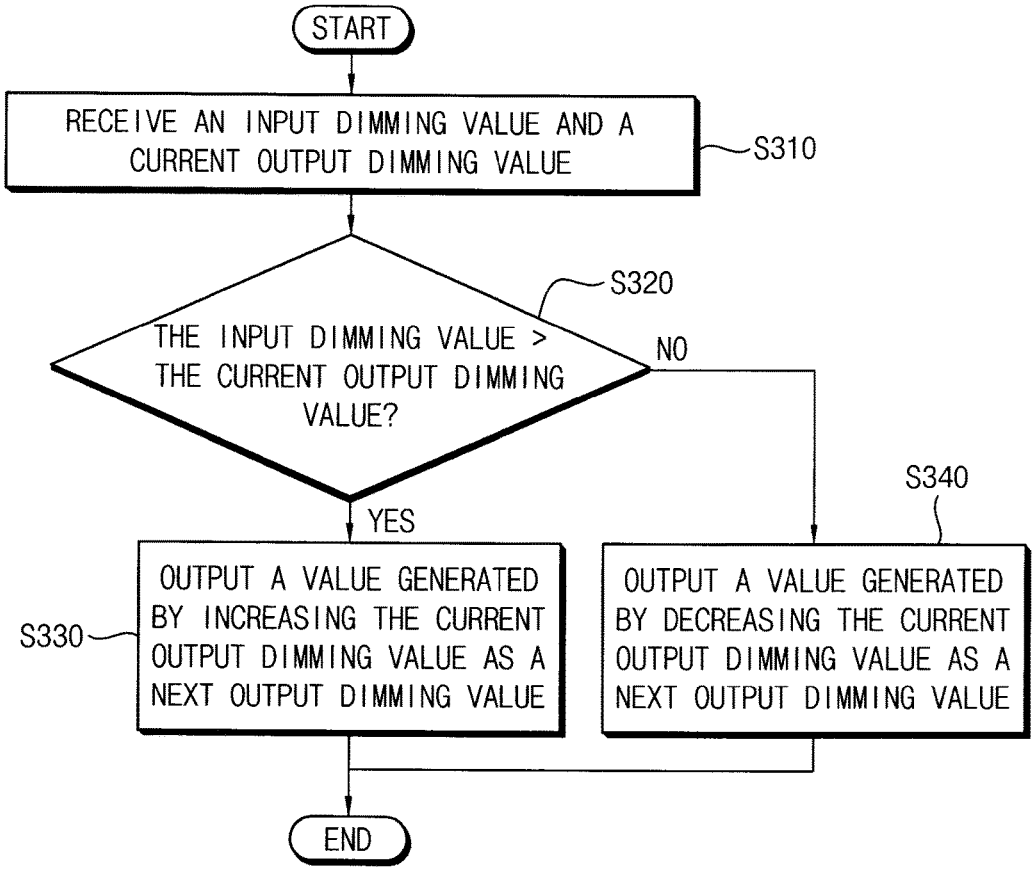
FIG. 4 is a flow chart illustrating an example in which a method of FIG. 1 performs a dimming operation.

FIG. 4 is a flow chart illustrating an example embodiment of the method of controlling a dimming operation illustrated in FIG. 1 including performing a dimming operation.

In the embodiment of FIG. 4 that an absolute value of a difference between an input dimming value and a current output dimming value is smaller than a predetermined threshold value. Specifically, the method of FIG. 4 includes receiving the input dimming value and the current output dimming value (Step S310), and determining whether the input dimming value is greater than the current output dimming value (Step S320). Here, in one aspect, when the input dimming value is greater than the current output dimming value, the method of FIG. 1 outputs a value generated by increasing the current output dimming value by a predetermined adjustment value as a next output dimming value (Step S330). In contrast, in another aspect, when the input dimming value is smaller than the current output dimming value, the method of FIG. 1 outputs a value generated by decreasing the current output dimming value by the predetermined adjustment value as the next output dimming value (Step S340).

As described above, when deciding to perform the dimming operation, the method of FIG. 1 generates a value by adjusting (i.e., increasing or decreasing) the current output dimming value by the predetermined adjustment value based on a comparison the input dimming value and the current output dimming value (i.e., based on which is greater between the input dimming value and the current output dimming value), and outputs the generated value as the next output dimming value. In one aspect of the method, when an image output from a flat panel display device becomes brighter, the input dimming value (i.e., related to the input image frame that is currently input) is greater than the current output dimming value (i.e., related to the input image frame that is currently output). Hence, this aspect of the method of FIG. 1 includes outputting a value generated by increasing the current output dimming value by the predetermined adjustment value as the next output dimming value. In another aspect of the method, when the image output from the flat panel display device becomes darker, the input dimming value (i.e., related to the input image frame that is currently input) is smaller than the current output dimming value (i.e., related to the input image frame that is currently output). Hence, this aspect of the method of FIG. 1 includes outputting a value generated by decreasing the current output dimming value by the predetermined adjustment value as the next output dimming value. In conclusion, the method of FIG. 1 can include gradually adjusting the brightness of the image output from the flat panel display device by performing the dimming operation when the absolute value of the difference between the input dimming value and the current output dimming value is smaller than the predetermined threshold value (i.e., when it is expected that the brightness of the image output from the flat panel display device will be gradually changed).

Figure 5:
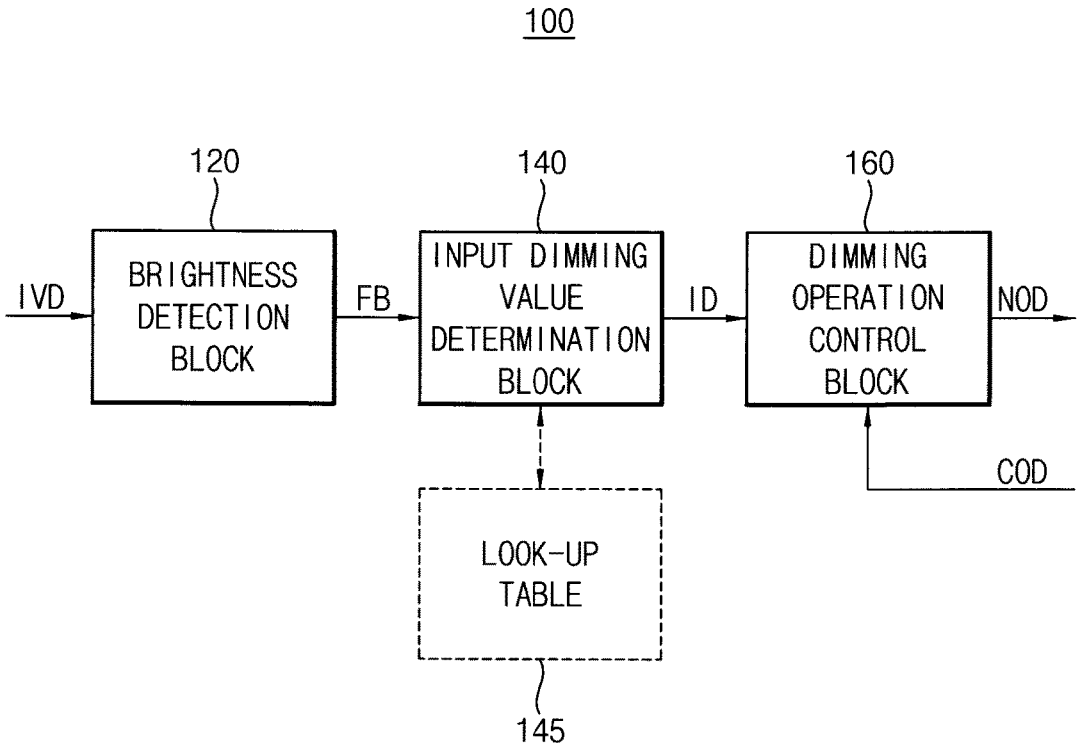
FIG. 5 is a block diagram illustrating a dimming operation control device according to example embodiments.

FIG. 5 is a block diagram illustrating a dimming operation control device according to example embodiments.

Referring to FIG. 5, the dimming operation control device 100 includes a brightness detection block 120, an input dimming value determination block 140, and a dimming operation control block 160. In some example embodiments, the dimming operation control device 100 may further include a look-up table 145.

In one embodiment, the brightness detection block 120 is configured to externally receive an input image data IVD, and determine a brightness FB of the input image frame based on the input image data IVD. In one example embodiment, the brightness detection block 120 converts the input image data IVD corresponding to RGB data into a luminance signal (i.e., Y signal) including brightness information, calculates an average brightness based on the luminance signal, and set the brightness FB of the input image frame as the average brightness. The input dimming value determination block 140 is configured to determine an input dimming value ID based on the brightness FB of the input image frame. In one example embodiment, the input dimming value determination block 140 determines the input dimming value ID by selecting a dimming value matched to the brightness FB of the input image frame using the look-up table 145. Here, the look-up table 145 can store a plurality of dimming values matched to a plurality of brightness FB of the input image frame, respectively. In addition, it will be understood by a person skilled in the art that the look-up table 145 can be implemented by any storage device capable of storing a plurality of dimming values matched to a plurality of brightness FB of the input image frame, respectively.

The dimming operation control block 160 is configured to decide whether to perform the dimming operation by comparing an absolute value of a difference between the input dimming value ID and the current output dimming value COD against a predetermined threshold value. Here, it will be recognized that the input dimming value ID is corresponds to the input image frame that is currently being inputted, and that the current output dimming value COD corresponds to the input image frame that is currently being outputted. In one aspect, the dimming operation control block 160 decides to perform the dimming operation if the absolute value of the difference between the input dimming value ID and the current output dimming value COD is smaller than the predetermined threshold value. On the other hand, in another aspect, the dimming operation control block 160 decides not to perform the dimming operation if the absolute value of the difference between the input dimming value ID and the current output dimming value COD is greater than the predetermined threshold value. That is, in one aspect, the dimming operation control block 160 may gradually adjust a brightness of an image output from a flat panel display device by performing the dimming operation when the absolute value of the difference between the input dimming value ID and the current output dimming value COD is relatively small (i.e., when it is expected that the brightness of the image output from the flat panel display device will change gradually). However, in another aspect, the dimming operation control block 160 may promptly counteract rapid brightness changes of the image output from the flat panel display device (i.e., may not perform the dimming operation) when the absolute value of the difference between the input dimming value ID and the current output dimming value COD is relatively large (i.e., when it is expected that the brightness of the image output from the flat panel display device will change rapidly).

As described above, in one aspect, the dimming operation control block 160 may gradually adjust the brightness of the image output from the flat panel display device by performing the dimming operation when the absolute value of the difference between the input dimming value ID and the current output dimming value COD is smaller than the predetermined threshold value. In detail, the dimming operation control block 160 may output a value generated by decreasing the current output dimming value COD by the predetermined adjustment value as the next output dimming value NOD when the input dimming value ID is smaller than the current output dimming value COD, and may output a value generated by increasing the current output dimming value COD by the predetermined adjustment value as the next output dimming value NOD when the input dimming value ID is greater than the current output dimming value COD. As described above, when the absolute value of the difference between the input dimming value ID and the current output dimming value COD is smaller than the predetermined threshold value, the dimming operation control block 160 may gradually adjust the brightness of the image output from the flat panel display device by adjusting the current output dimming value COD based on a comparison between the input dimming value ID and the current output dimming value COD.

On the other hand, in another aspect, when the absolute value of the difference between the input dimming value ID and the current output dimming value COD is greater than the predetermined threshold value, the dimming operation control block 160 may output the input dimming value ID as the next output dimming value NOD. That is, when the absolute value of the difference between the input dimming value ID and the current output dimming value COD is greater than the predetermined threshold value, the dimming operation control block 160 may promptly counteract the rapid brightness changes of the image output from the flat panel display device (i.e., may not perform the dimming operation) by directly applying the input dimming value ID. As described above, the dimming operation control block 160 may selectively perform the dimming operation by comparing the absolute value of the difference between the input dimming value ID and the current output dimming value COD with the predetermined threshold value when performing the dimming operation based on the brightness FB of the input image frame. As a result, the dimming operation control device 100 may prevent the bright changes or the color changes of the image output from the flat panel display device when the brightness FB of the input image frame changes rapidly.

Meanwhile, the predetermined threshold value and the predetermined adjustment value can be determined according to various required conditions for the flat panel display device. In addition, the flat panel display device having the dimming operation control device 100 may be a liquid crystal display device or an organic light emitting display device. However, a type of the flat panel display device having the dimming operation control device 100 is not limited thereto. For example, the flat panel display device may be a plasma display panel device. In one example embodiment, the dimming operation may correspond to a local dimming operation. In this case, the dimming operation control device 100 may separately perform the dimming operation on respective regions of the display panel of the flat panel display device. In another example embodiment, the dimming operation may correspond to a global dimming operation. In this case, the dimming operation control device 100 may simultaneously perform the dimming operation on an entire region of the display panel of the flat panel display device.

Figure 6A:
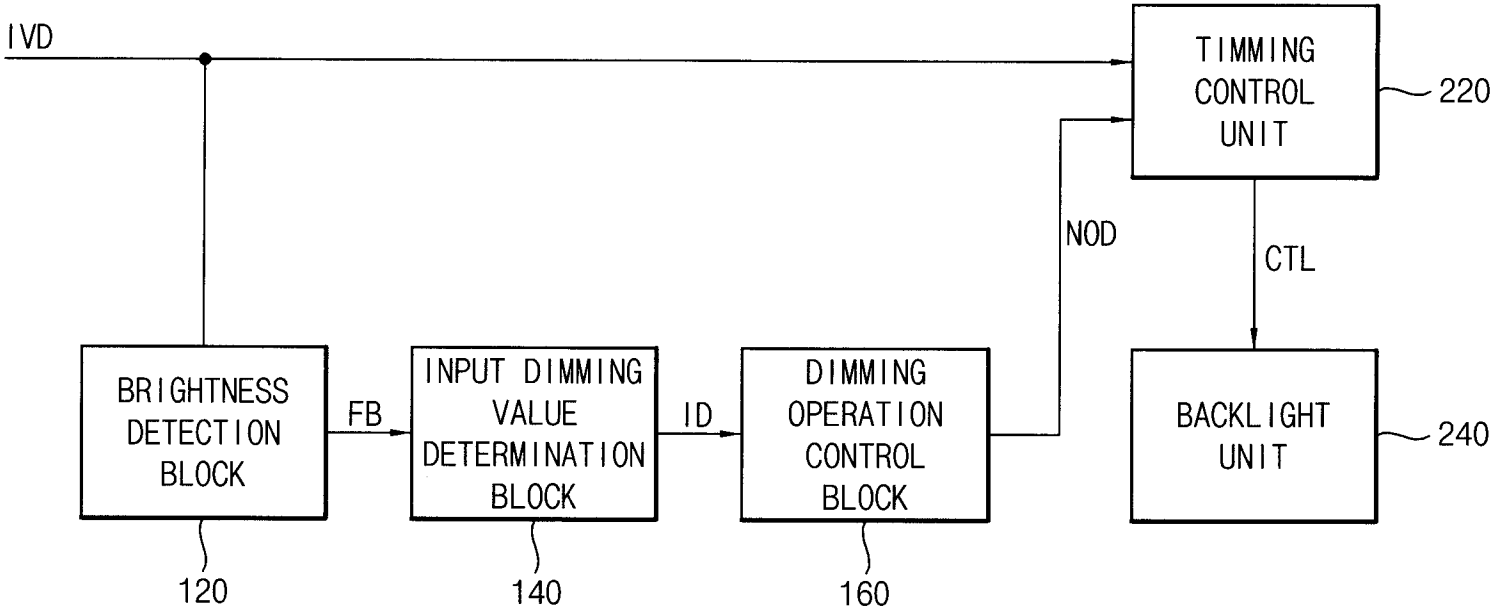
FIGS. 6A through 6C are block diagrams illustrating various examples in which a dimming operation control device of FIG. 5 is included in a liquid crystal display device.
Figure 6B:
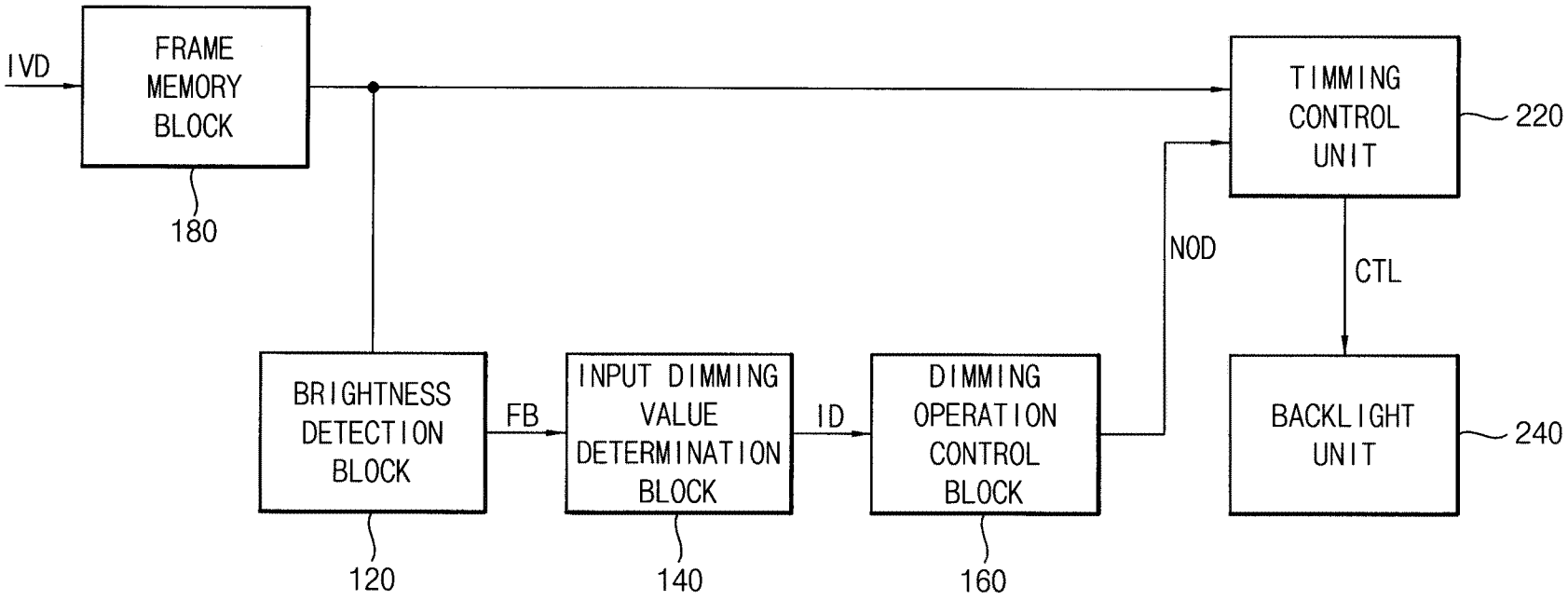
Figure 6C:
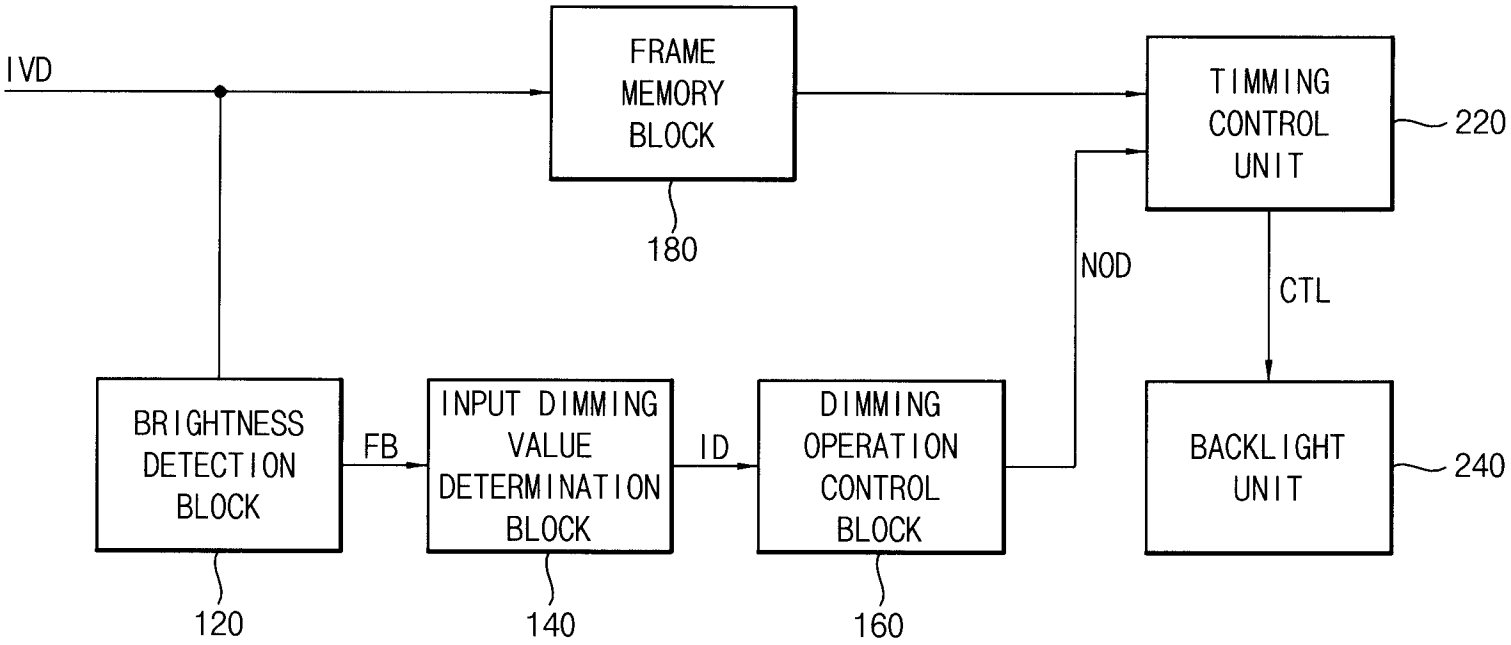

FIGS. 6A through 6C are block diagrams illustrating various example embodiments in which a dimming operation control device of FIG. 5 is included in a liquid crystal display device.

FIGS. 6A through 6C illustrates the dimming operation control device 100 including the brightness detection block 120, the input dimming value determination block 140, and the dimming operation control block 160 according to various embodiments.

FIG. 6A shows one example embodiment in which the dimming operation control device 100 is coupled to the timing control unit 220 of the liquid crystal display device, where the dimming operation control device 100 does not include a frame memory block according to one embodiment. As described above, the dimming operation control device 100 may receive the input image data IVD externally, determine the brightness FB of the input image frame based on the input image data IVD, and selectively perform the dimming operation based on the brightness FB of the input image frame. Depending on deciding whether or not to perform the dimming operation, the dimming operation control device 100 outputs either a value generated by adjusting (i.e., increasing or decreasing) the current output dimming value by the predetermined adjustment value as the next output dimming value NOD, or the input dimming value ID as the next output dimming value NOD. Subsequently, the timing control unit 220 adjusts the brightness of the image output from the liquid crystal display device by providing a control signal CTL to the backlight unit 240 based on the next output dimming value NOD output from the dimming operation control device 100. For example, the timing control unit 220 may adjust the brightness of the image output from the liquid crystal display device by multiplying an intensity of light output from the backlight unit 240 by the next output dimming value NOD.

FIGS. 6B and 6C show other example embodiments in which the dimming operation control device 100 is coupled to the timing control unit 220 of the liquid crystal display device, where the dimming operation control device 100 further includes a frame memory block 180. For example, as illustrated in FIG. 6B, the input image data IVD may be temporarily stored in the frame memory block 180, and then may be provided to the brightness detection block 120 and the timing control unit 220. In addition, as illustrated in FIG. 6C, after the input image data IVD is provided to the brightness detection block 120, the input image data IVD may be temporarily stored in the frame memory block 180, and subsequently be provided to the timing control unit 220. However, an arrangement of the frame memory block 180 is not limited thereto. For example, the frame memory block 180 may be placed behind the timing control unit 220. In this case, the frame memory unit 180 may temporarily store the input image data IVD output from the timing control unit 220. The timing control unit 220 may adjust the brightness of the image output from the liquid crystal display device by providing the control signal CTL to the backlight unit 240 based on the next output dimming value NOD output from the dimming operation control device 100. For example, the timing control unit 220 may adjust the brightness of the image output from the liquid crystal display device by multiplying the intensity of the light output from the backlight unit 240 by the next output dimming value NOD.

Figure 7A:
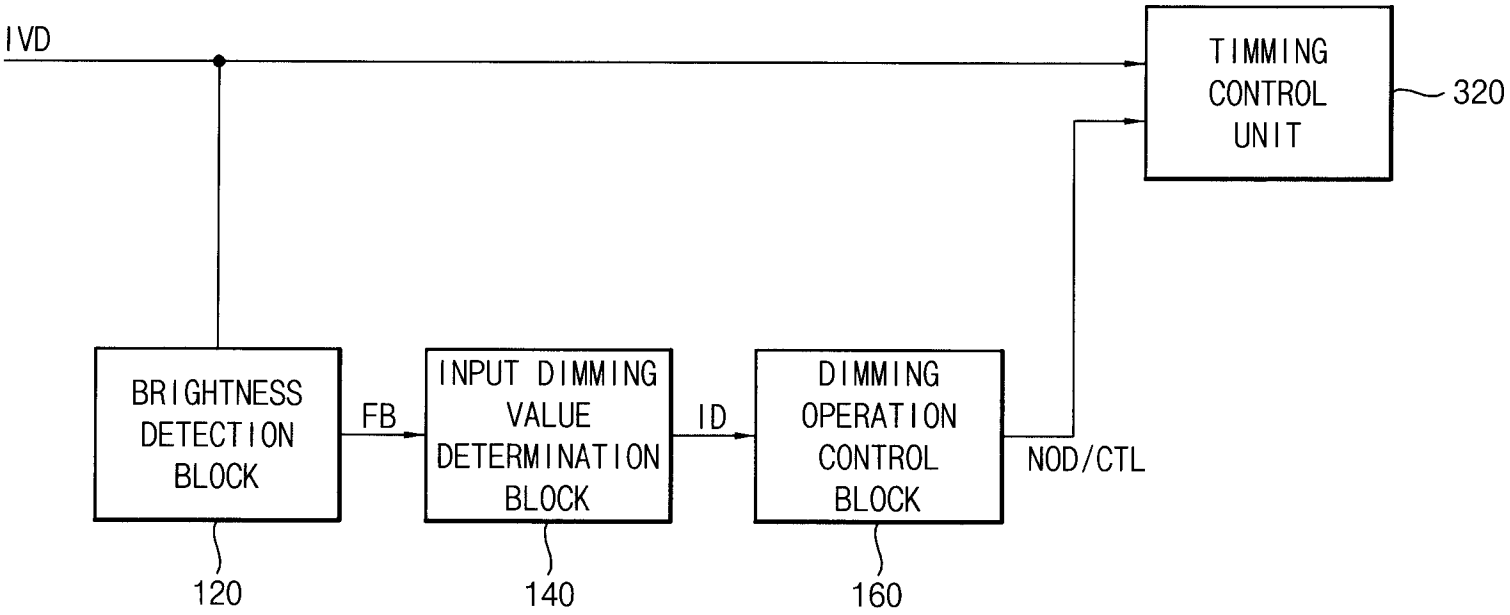
FIGS. 7A through 7C are block diagrams illustrating various examples in which a dimming operation control device of FIG. 5 is included in an organic light emitting display device.
Figure 7B:
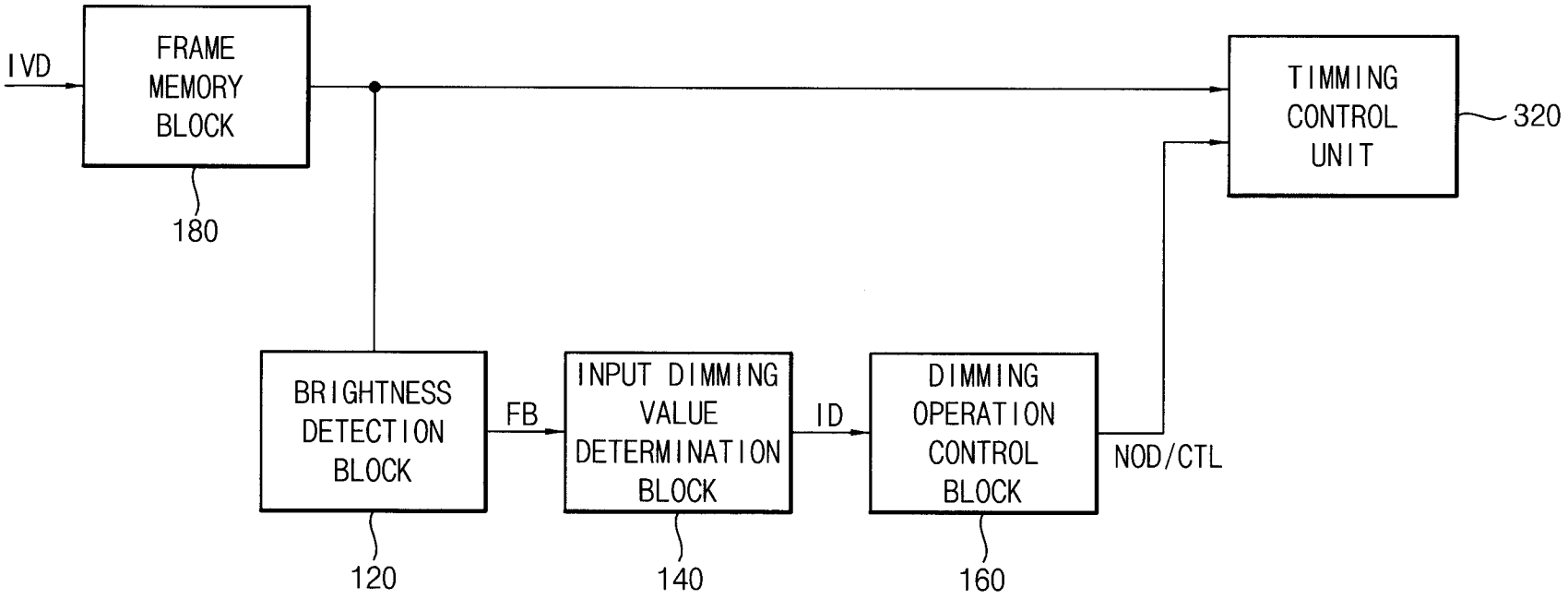
Figure 7C:
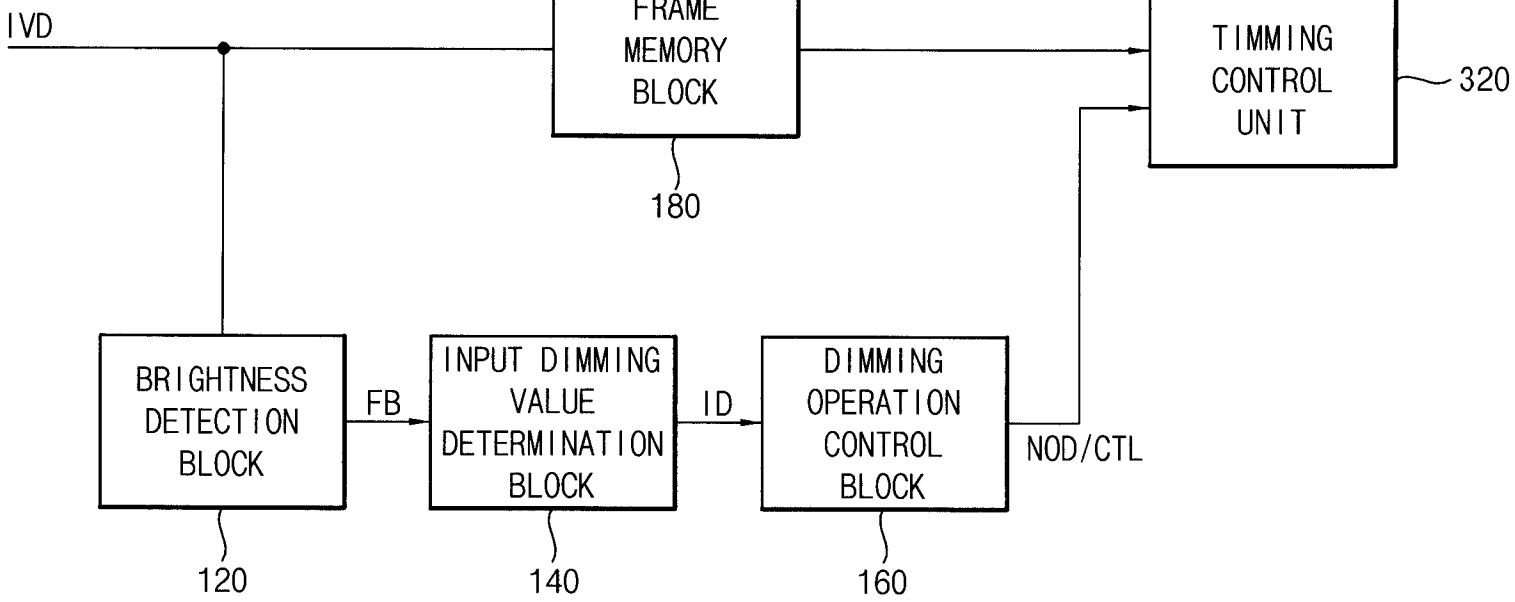

FIGS. 7A through 7C are block diagrams illustrating various example embodiments in which a dimming operation control device of FIG. 5 is included in an organic light emitting display device.

FIGS. 7A through 7C illustrates the dimming operation control device 100 including the brightness detection block 120, the input dimming value determination block 140, and the dimming operation control block 160 according to various embodiments.

FIG. 7A show an example in which the dimming operation control device 100 is coupled to the timing control unit 320 of the organic light emitting display device, where the dimming operation control device 100 does not include a frame memory block according to one embodiment. As described above, the dimming operation control device 100 may receive the input image data IVD externally, determine the brightness FB of the input image frame based on the input image data IVD, and selectively perform the dimming operation based on the brightness FB of the input image frame. Depending on deciding whether or not to perform the dimming operation, the dimming operation control device 100 may output either a value generated by adjusting (i.e., increasing or decreasing) the current output dimming value by the predetermined adjustment value as the next output dimming value NOD, or the input dimming value ID as the next output dimming value NOD. Subsequently, the timing control unit 320 may adjust the brightness of the image output from the organic light emitting display device based on the next output dimming value NOD output from the dimming operation control device 100. For example, the timing control unit 320 may adjust the brightness of the image output from the organic light emitting display device by adjusting a data signal that is applied to pixels (e.g., a voltage signal or a current signal). FIG. 7B shows an example in which the dimming operation control device 100 is coupled to the timing control unit 320 of the organic light emitting display device, where the dimming operation control device 100 further includes a frame memory block 180 according to another embodiment. In this case, the input image data IVD may be temporarily stored in the frame memory block 180, and then may be provided to the brightness detection block 120 and the timing control unit 320. FIG. 7C shows an example in which the dimming operation control device 100 is coupled to the timing control unit 320 of the organic light emitting display device, where the dimming operation control device 100 further includes the frame memory block 180 according to yet another embodiment. In this case, after the input image data IVD is provided to the brightness detection block 120, the input image data IVD may be temporarily stored in the frame memory block 180, and then may be provided to the timing control unit 320.

Figure 8:
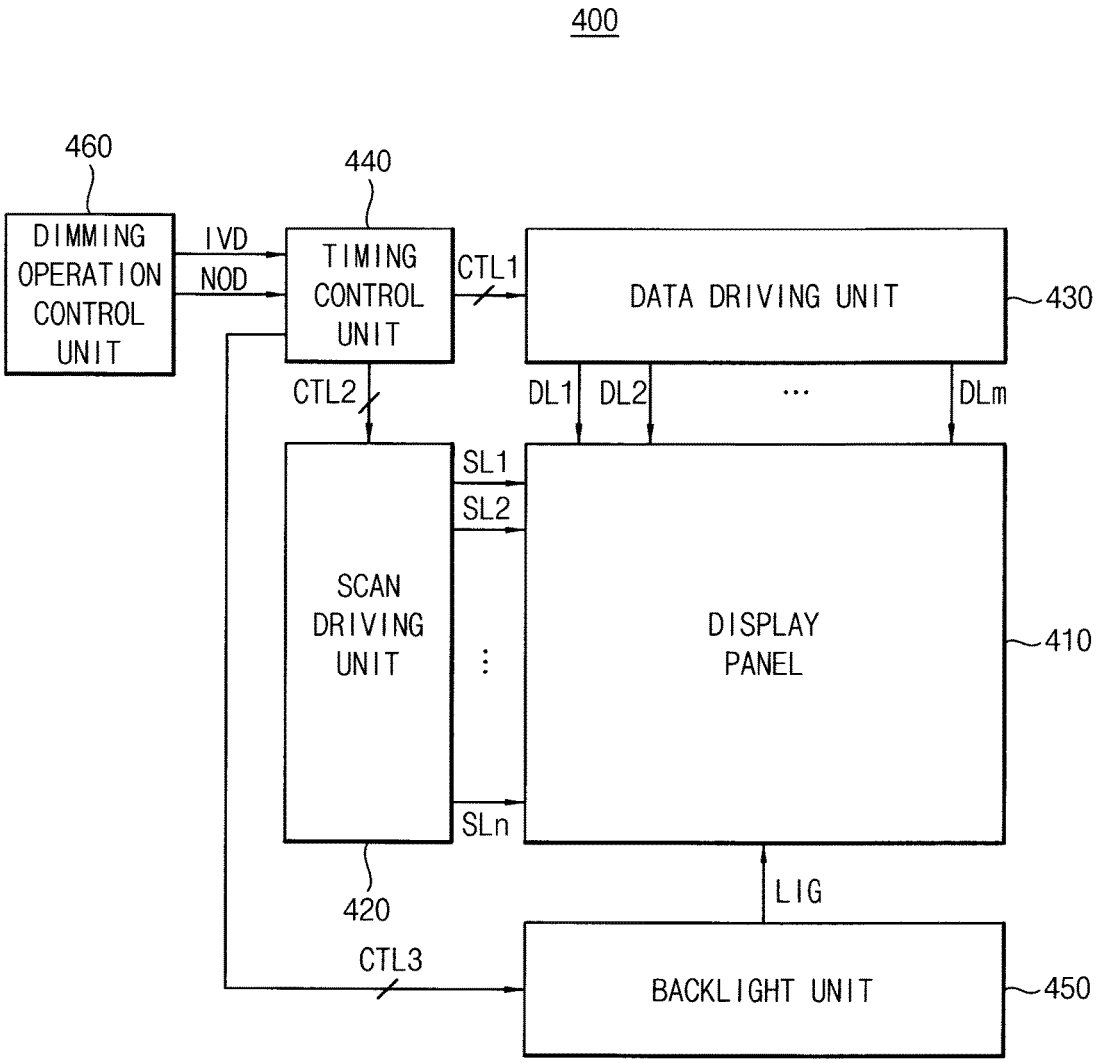
FIG. 8 is a block diagram illustrating a liquid crystal display device according to example embodiments.

FIG. 8 is a block diagram illustrating a dimming operation-controlled liquid crystal display device according to example embodiments.

Referring to FIG. 8, the liquid crystal display device 400 includes a display panel 410, a scan driving unit 420, a data driving unit 430, a timing control unit 440, a backlight unit 450, and a dimming operation control unit 460 according to one embodiment. Here, the dimming operation control unit 460 can correspond to the dimming operation control device 100 of FIG. 5.

The display panel 410 includes a plurality of pixels according to an embodiment. Here, each pixel may include a liquid crystal layer. In one example embodiment, each pixel may include a switching element (e.g., a thin film transistor (TFT)), a liquid crystal capacitor, and a storage capacitor. In this case, the switching element may operate to provide a data signal, where the data signal is provided via data-lines DL1 through DLm, to the liquid crystal capacitor based on a scan signal, where the scan signal is provided via scan-lines SL1 through SLn. The liquid crystal capacitor may be charged based on the data signal to control a light-transmittance of the liquid crystal layer. The storage capacitor may maintain a voltage of the liquid crystal capacitor. The scan driving unit 420 provides the scan signal to the pixels via the scan-lines SL1 through SLn. The data driving unit 430 provides the data signal to the pixels via the data-lines DL1 through DLm. The backlight unit 450 provides light LIG to the display panel 410. The timing control unit 440 generates and provides a plurality of control signals CTL1, CTL2, and CTL3 to control the scan driving unit 420, the data driving unit 430, and the backlight unit 450.

The dimming operation control unit 460 selectively performs a dimming operation by comparing an absolute value of a difference between an input dimming value and a current output dimming value against a predetermined threshold value. Depending on deciding whether or not to perform the dimming operation, the dimming operation control unit 460 may output either a value generated by adjusting the current output dimming value by a predetermined adjustment value as a next output dimming value NOD, or the input dimming value as the next output dimming value NOD. Subsequently, the timing control unit 440 adjusts a brightness of an image output from the liquid crystal display device 400 based on the next output dimming value NOD output from the dimming operation control unit 460. To this end, the dimming operation control unit 460 may include a brightness detection block, an input dimming value determination block, and a dimming operation control block. The brightness detection block may determine a brightness of an input image frame based on an input image data IVD. The input dimming determination block may determine the input dimming value based on the brightness of the input image frame. The dimming operation control block may decide whether to perform the dimming operation by comparing the absolute value of the difference between the input dimming value and the current output dimming value against the predetermined threshold value, may output a value generated by adjusting (i.e., increasing or decreasing) the current output dimming value by the predetermined adjustment value as the next output dimming value NOD when it is decided to perform the dimming operation, and may output the input dimming value as the next output dimming value NOD when it is decided not to perform the dimming operation. Since the dimming operation control unit 460 is described above, duplicated descriptions will be omitted below.

As described above, the dimming operation control unit 460 selectively performs the dimming operation based on the brightness of the input image frame. Particularly, the dimming operation control unit 460 may selectively perform the dimming operation by comparing the absolute value of the difference between the input dimming value and the current output dimming value against the predetermined threshold value. On this basis, the liquid crystal display device 400 may prevent the brightness changes or the color changes of the image output from the liquid crystal display device 400 when the brightness of the input image frame changes rapidly. As a result, the liquid crystal display device 400 may output (i.e., display) a high-quality image. Although it is illustrated in FIG. 8 that the dimming operation control unit 460 is coupled to the timing control unit 450, the dimming operation control unit 460 may be included in the timing control unit 440.

Figure 9:
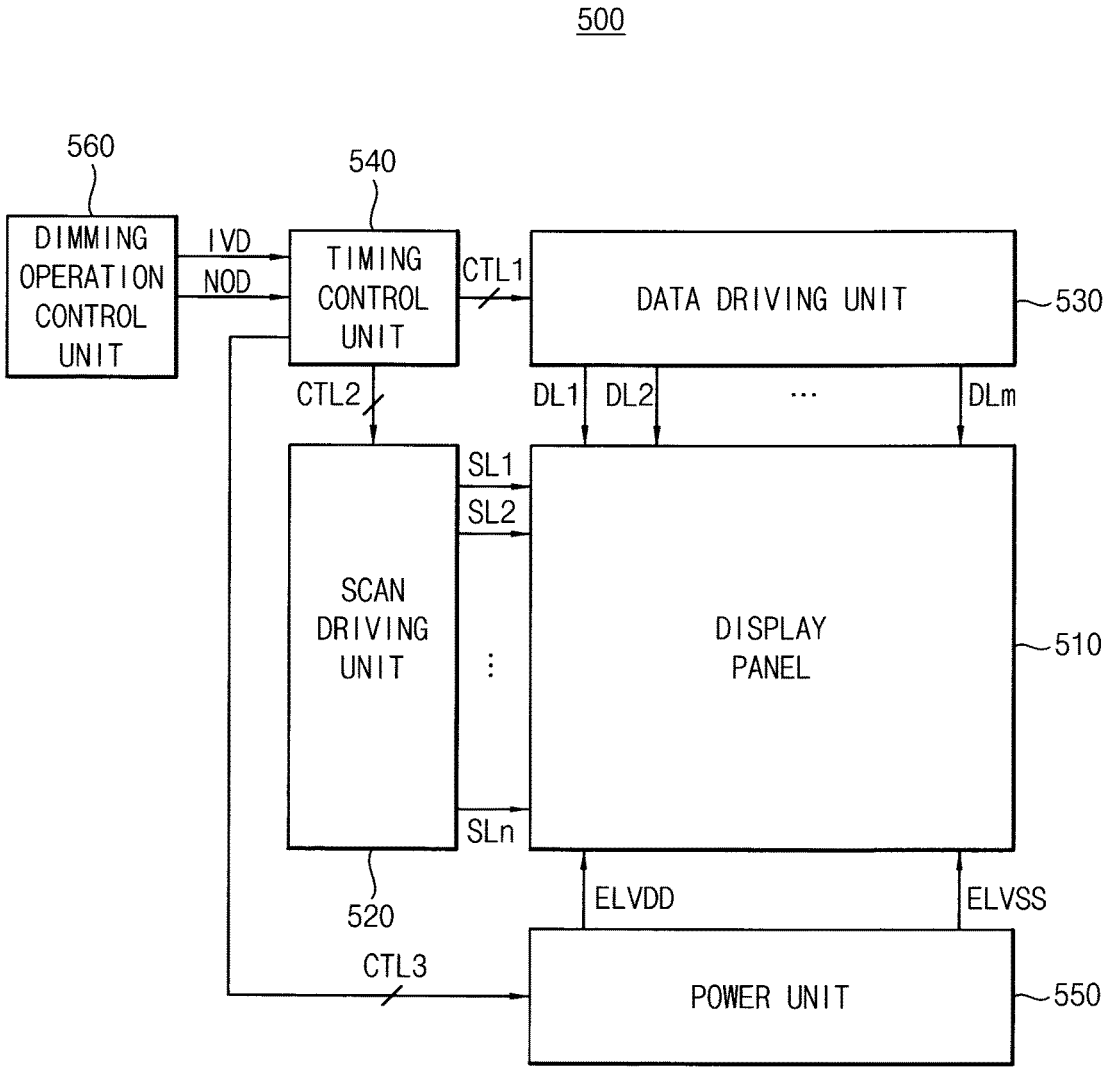
FIG. 9 is a block diagram illustrating an organic light emitting display device according to example embodiments.

FIG. 9 is a block diagram illustrating a dimming operation-controlled organic light emitting display device according to example embodiments.

Referring to FIG. 9, the organic light emitting display device 500 includes a display panel 510, a scan driving unit 520, a data driving unit 530, a timing control unit 540, a power unit 550, and a dimming operation control unit 560. Here, the dimming operation control unit 560 may correspond to the dimming operation control device 100 of FIG. 5.

The display panel 510 includes a plurality of pixels according to an embodiment. Here, each pixel may include an organic light emitting diode. In one example embodiment, each pixel may include a pixel circuit, a driving transistor, and an organic light emitting diode. In this case, the pixel circuit may operate to provide a data signal, where the data signal is provided via data-lines DL1 through DLm, to the driving transistor based on a scan signal, where the scan signal is provided via scan-lines SL1 through SLn. The driving transistor may control a current flowing through the organic light emitting diode based on the data signal, and the organic light emitting diode may emit light based on the current. The scan driving unit 520 provides the scan signal to the pixels via the scan-lines SL1 through SLn. The data driving unit 530 provides the data signal to the pixels via the data-lines DL1 through DLm. The power unit 550 provides a high power voltage ELVDD and a low power voltage ELVSS to the pixels. The timing control unit 540 generates and provides a plurality of control signals CTL1, CTL2, and CTL3 to control the scan driving unit 520, the data driving unit 530, and the power unit 550.

The dimming operation control unit 560 selectively perform a dimming operation by comparing an absolute value of a difference between an input dimming value and a current output dimming value against a predetermined threshold value. Depending on deciding whether or not to perform the dimming operation, the dimming operation control unit 560 outputs either a value generated by adjusting the current output dimming value by a predetermined adjustment value as a next output dimming value NOD, or the input dimming value as the next output dimming value NOD. Subsequently, the timing control unit 540 adjusts a brightness of an image output from the organic light emitting display device 500 based on the next output dimming value NOD output from the dimming operation control unit 560. To this end, the dimming operation control unit 560 may include a brightness detection block, an input dimming value determination block, and a dimming operation control block. The brightness detection block may determine a brightness of an input image frame based on an input image data IVD. The input dimming determination block may determine the input dimming value based on the brightness of the input image frame. The dimming operation control block may decide whether to perform the dimming operation by comparing the absolute value of the difference between the input dimming value and the current output dimming value against the predetermined threshold value, may output a value generated by adjusting (i.e., increasing or decreasing) the current output dimming value by the predetermined adjustment value as the next output dimming value NOD when it is decided to perform the dimming operation, and may output the input dimming value as the next output dimming value NOD when it is decided not to perform the dimming operation. Since the dimming operation control unit 560 is described above, duplicated descriptions will be omitted below.

As described above, the dimming operation control unit 560 may perform the dimming operation based on the brightness of the input image frame. Particularly, the dimming operation control unit 560 may selectively perform the dimming operation by comparing the absolute value of the difference between the input dimming value and the current output dimming value with the predetermined threshold value. On this basis, the organic light emitting display device 500 may prevent the brightness changes or the color changes of the image output from the organic light emitting display device 500 when the brightness of the input image frame changes rapidly. As a result, the organic light emitting display device 500 may output (i.e., display) a high-quality image. Although it is illustrated in FIG. 9 that the dimming operation control unit 560 is coupled to the timing control unit 550, the dimming operation control unit 560 may be included in the timing control unit 540. In addition, although it is illustrated in FIG. 9 that the organic light emitting display device 500 employs a digital driving technique, the present inventive concept is not limited thereto. Thus, the present inventive concept may be applied to an organic light emitting display device employing any driving technique (e.g., an analog driving technique, a simultaneous emission driving technique, etc.).

Figure 10:
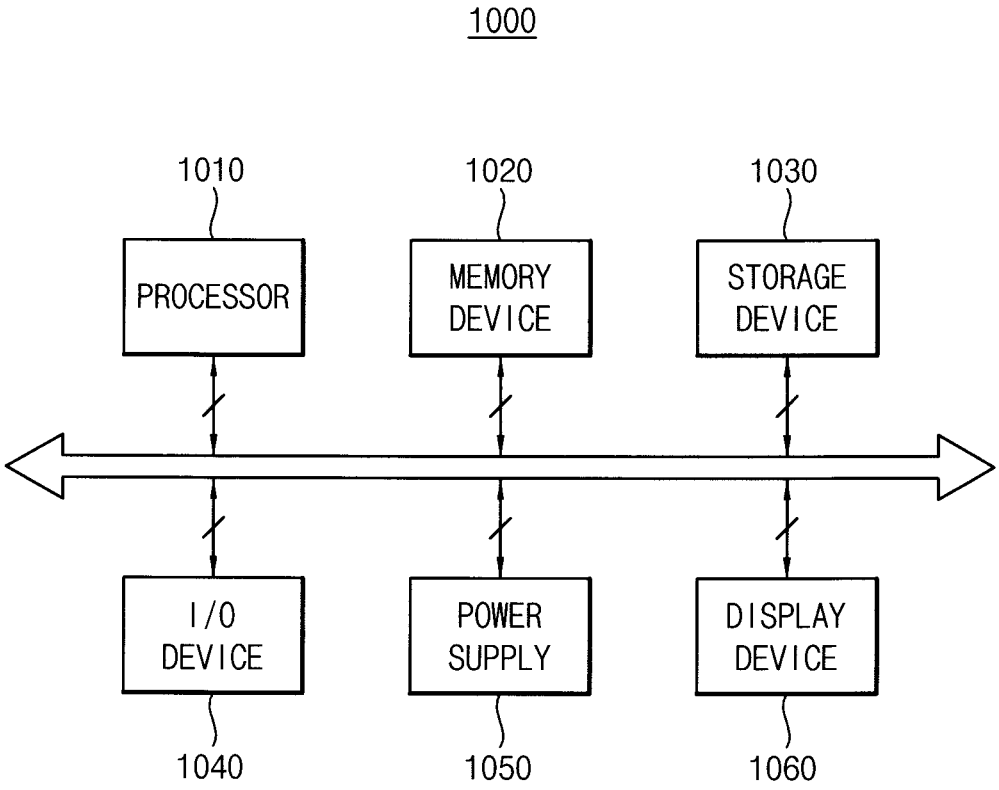
FIG. 10 is a block diagram illustrating an electronic device having a flat panel display device according to example embodiments.

FIG. 10 is a block diagram illustrating an electronic device having a flat panel display device according to example embodiments.

Referring to FIG. 10, the electronic device 1000 includes a processor 1010, a memory device 1020, a storage device 1030, an input/output (I/O) device 1040, a power supply 1050, and a flat panel display device 1060. In addition, the electronic device 1000 may further include a plurality of ports for communicating a video card, a sound card, a memory card, a universal serial bus (USB) device, other electronic devices, etc.

The processor 1010 performs various computing functions according to one embodiment. The processor 1010 may be a micro processor, a central processing unit (CPU), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 1030 may be a solid state drive (SSD) device, a hard disk drive (HDD) device, a CD-ROM device, etc.

The I/O device 1040 may be an input device such as a keyboard, a keypad, a touchpad, a touch-screen, a mouse, etc., and an output device such as a printer, a speaker, etc. In some example embodiments, the flat panel display device 1060 may be included in the I/O device 1040. The power supply 1050 may provide power for operation of the electronic device 1000. The flat panel display device 1060 may communicate with other components via the buses or other communication links. According to one embodiment, as described above, the flat panel display device 1060 performs a dimming operation based on a brightness of an input image frame when the flat panel display device outputs (i.e., displays) an image. Here, the flat panel display device 1060 includes a dimming operation control unit that selectively performs the dimming operation by comparing an absolute value of a difference between an input dimming value and a current output dimming value against a predetermined threshold value. Therefore, the flat panel display device 1060 may prevent brightness changes or color changes of the image output from the flat panel display device 1060 when the brightness of the input image frame is rapidly changed. As a result, the flat panel display device 1060 may display a high-quality image. In one example embodiment, the flat panel display device 1060 may be a liquid crystal display device. In this case, the flat panel display device 1060 includes a display panel, a scan driving unit, a data driving unit, a backlight unit, a timing control unit, a dimming operation control unit, etc. In another example embodiment, the flat panel display device 1060 may be an organic light emitting display device. In this case, the flat panel display device 1060 includes a display panel, a scan driving unit, a data driving unit, a power unit, a timing control unit, a dimming operation control unit, etc. However, a type of the flat panel display device 1060 is not limited thereto.

The present inventive concept may be applied to a system having a flat panel display device. For example, the present inventive concept may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of controlling a dimming operation, comprising:

determining the brightness of an input image frame based on input image data;

determining an input dimming value based on the brightness of the input image frame;

deciding to perform the dimming operation when an absolute value of a difference between the input dimming value and a current output dimming value is smaller than a predetermined threshold value, or deciding not to perform the dimming operation when the absolute value of the difference between the input dimming value and the current output dimming value is greater than the predetermined threshold value, wherein a difference in brightness between the input image frame and a current output image frame is relatively smaller when the absolute value of the difference is such that the dimming operation is decided to be performed, and whereas the difference in brightness between the input image frame and the current output image frame is relatively greater when the absolute value of the difference is such that the dimming operation is decided not performed; and outputting as a next output dimming value one of a value generated by adjusting the current output dimming value by a predetermined adjustment value when deciding to perform the dimming operation and the input dimming value when deciding not to perform the dimming operation.

2. The method of claim 1, wherein determining the brightness of the input image frame includes:

converting the input image data corresponding to RGB data into a luminance signal including brightness information; and setting the brightness of the input image frame as an average brightness after calculating the average brightness based on the luminance signal.

3. The method of claim 1, wherein determining the input dimming value includes:

selecting a dimming value matched to the brightness of the input image frame using a look-up table as the input dimming value.

4. The method of claim 1, wherein outputting the value generated by adjusting the current output dimming value by the predetermined adjustment value as the next output dimming value includes:

outputting as the next output dimming value one of a value generated by decreasing the current output dimming value by the predetermined adjustment value when the input dimming value is smaller than the current output dimming value and a value generated by increasing the current output dimming value by the predetermined adjustment value when the input dimming value is greater than the current output dimming value.

5. The method of claim 1, wherein the dimming operation corresponds to a local dimming operation, and wherein the dimming operation is separately performed on respective regions of a display panel of a flat panel display device.

6. The method of claim 1, wherein the dimming operation corresponds to a global dimming operation, and wherein the dimming operation is simultaneously performed on an entire region of a display panel of a flat panel display device.

7. A dimming operation control device comprising:

a brightness detection block configured to receive input image data, and to determine the brightness of an input image frame based on the input image data;

an input dimming value determination block configured to determine an input dimming value based on the brightness of the input image frame; and a dimming operation control block configured to decide to perform a dimming operation when an absolute value of a difference between the input dimming value and a current output dimming value is smaller than a predetermined threshold value, configured to decide not to perform a dimming operation when the absolute value of the difference between the input dimming value and the current output dimming value is greater than the predetermined threshold value, and further configured to output as a next output dimming value one of a value generated by adjusting the current output dimming value by a predetermined adjustment value when deciding to perform the dimming operation and the input dimming value when deciding not to perform the dimming operation, wherein a difference in brightness between the input image frame and a current output image frame is relatively smaller when the absolute value of the difference is such that the dimming operation is decided to be performed, and whereas the difference in brightness between the input image frame and the current output image frame is relatively greater when the absolute value of the difference is such that the dimming operation is decided not performed.

8. The device of claim 7, wherein the brightness detection block is configured to convert the input image data corresponding to RGB data into a luminance signal including brightness information, and to set the brightness of the input image frame as an average brightness after calculating the average brightness based on the luminance signal.

9. The device of claim 7, wherein the input dimming value determination block is configured to select a dimming value matched to the brightness of the input image frame using a look-up table as the input dimming value.

10. The device of claim 7, wherein the dimming operation control block outputs a value generated by decreasing the current output dimming value by the predetermined adjustment value as the next output dimming value when the input dimming value is smaller than the current output dimming value, and wherein the dimming operation control block outputs a value generated by increasing the current output dimming value by the predetermined adjustment value as the next output dimming value when the input dimming value is greater than the current output dimming value.

11. The device of claim 7, wherein the dimming operation corresponds to a local dimming operation, and wherein the dimming operation is separately performed on respective regions of a display panel of a flat panel display device.

12. The device of claim 7, wherein the dimming operation corresponds to a global dimming operation, and wherein the dimming operation is simultaneously performed on an entire region of a display panel of a flat panel display device.

13. A flat panel display device comprising:

a display panel including a plurality of pixels having respective organic light emitting diodes;

a scan driving unit configured to provide a scan signal to the pixels;

a data driving unit configured to provide a data signal to the pixels;

a power unit configured to provide a high power voltage and a low power voltage to the pixels;

a timing control unit configured to control the scan driving unit, the data driving unit, and the power unit; and a dimming operation control unit configured to decide to perform a dimming operation when an absolute value of a difference between the input dimming value and a current output dimming value is smaller than a predetermined threshold value, and configured to decide not to perform a dimming operation when the absolute value of the difference between the input dimming value and the current output dimming value is greater than the predetermined threshold value, wherein a difference in brightness between the input image frame and a current output image frame is relatively smaller when the absolute value of the difference is such that the dimming operation is decided to be performed, and whereas the difference in brightness between the input image frame and the current output image frame is relatively greater when the absolute value of the difference is such that the dimming operation is decided not performed.

14. The device of claim 13, wherein the dimming operation control unit is coupled to the timing control unit.

15. The device of claim 13, wherein the dimming operation control unit is located in the timing control unit.

16. The device of claim 14, wherein the dimming operation control unit includes:

a brightness detection block configured to receive input image data, and to determine the brightness of the input image frame based on the input image data;

an input dimming value determination block configured to determine the input dimming value based on the brightness of the input image frame; and a dimming operation control block configured to decide whether or not to perform the dimming operation by comparing the absolute value of the difference between the input dimming value and the current output dimming value against the predetermined threshold value, to output as a next output dimming value one of a value generated by adjusting the current output dimming value by a predetermined adjustment value when deciding to perform the dimming operation and the input dimming value when deciding not to perform the dimming operation.

* * * * *